United States Patent [19]

Schiller

[11] Patent Number: 4,627,261

[45] Date of Patent: Dec. 9, 1986

[54] ROLL STAND WITH AXIALLY SHIFTABLE WORKING ROLLS

[75] Inventor: Günter Schiller, Kreuztal, Fed. Rep. of Germany

[73] Assignee: SMS Schloemann-Siemag AG, Dusseldorf, Fed. Rep. of Germany

[21] Appl. No.: 711,777

[22] Filed: Mar. 14, 1985

[30] Foreign Application Priority Data

Mar. 14, 1984 [DE] Fed. Rep. of Germany ..... 3409221

[51] Int. Cl.[4] ..... B21B 31/18; B21B 31/32

[52] U.S. Cl. ..... 72/247; 72/238; 72/243; 72/245

[58] Field of Search ..... 72/243, 245, 247, 242, 72/238

[56] References Cited

U.S. PATENT DOCUMENTS 3,864,955 2/1975 Eibe ..... 72/245
4,059,976 11/1977 Christ et al. ..... 72/242
4,499,748 2/1985 Nihei et al. ..... 72/247

FOREIGN PATENT DOCUMENTS 3038865 12/1982 Fed. Rep. of Germany .

*Primary Examiner*—Francis S. Husar
*Assistant Examiner*—Steve Katz
*Attorney, Agent, or Firm*—Karl F. Ross; Herbert Dubno

[57] ABSTRACT

A roll stand comprises a plurality of axially shiftable working rolls, each attached by supporting members axially slidably to a guide member which is movable vertically adjustably against the side of a cylinder block installed in the roll stand housing. Axially shifting hydraulic cylinders are provided to axially shift the working rolls by acting on the guide pieces. In particular a plurality of balancing hydraulic cylinders are installed in laterally projecting shoulders in the cylinder blocks behind each other in the axial shifting direction of the rolls and act on the working rolls to provide balancing and bending forces. In order to install only cylinder blocks of reduced size, the balancing hydraulic cylinders operating downwardly and the balancing hydraulic cylinders taken individually along the axial shifting direction project alternately downward and upward from the shoulder of the cylinder block associated with them and act on the guide pieces on which the working rolls are mounted.

20 Claims, 4 Drawing Figures

ROLL STAND WITH AXIALLY SHIFTABLE WORKING ROLLS

FIELD OF THE INVENTION

My present invention relates to a roll stand used for example in strip rolling mills and, more particularly, to a roll stand having rolls mounted rotatably on journal members which can shift axially on guide members which are displaceable vertically along cylinder blocks, wherein the relative position and balancing of these rolls can automatically be controlled and adjusted and especially the bending of the working rolls can be controlled and the working rolls can be axially shifted.

BACKGROUND OF THE INVENTION

A multiroll roll stand can comprise a plurality of axially shiftable working rolls, structural members of which are guided slidably axially in one of a plurality of guide members, these guide members being slidable vertically along a cylinder block having at least one balancing hydraulic cylinder for controlledly balancing and bending the working rolls, and wherein the guide members are associated with similar axially shifting hydraulic cylinders for sliding the working rolls axially Roll stands constructed with a plurality of slidable working and/or intermediate rolls (i.e. rolls between the working rolls and backing rolls) have been provided, for example, to be able to shift wear regions by sliding the working rolls, to provide favorable initial positions for roller bending, and particularly however, in order to be able according to the principle of "bottle rolls" by sliding of two noncylindrical rolls with complementarily shaped surfaces relative to each other to alter the resulting amount of bulging and, therefore, the shape of the nip or rolling-gap profile between the rolls (see German patent DE-PS No. 30 38 865).

Since there is in general the need for additional control of the shape of the opening between the rolls, a roll stand is desired which also allows generation of desired bending moments, i.e. the intentional application of bending moments to the working rolls.

In practice it has been found that the organization of the required elements for this task creates difficulties. Thus, for example, powerful hydraulic cylinders are required for both shifting of the working rolls and also particularly for balancing of the upper backing roll to permit the desired shifting and generation of the bending moments.

When high operating force is necessary in operation of these hydraulic cylinders, they must be of a corresponding large diameter and then can take up excessive amounts of space.

Particularly in the choice of sliding supports for the backing rolls and also in the choice of their sliding supporting bearing members considerations regarding the lubricating oil inlet and outlet fittings involve substantial space requirements. Under these conditions it has been found in the past to be necessary for the shifting of the working rolls to put the hydraulic cylinders and those for sliding the supporting rolls outside of the stand.

This means not only that additional space is required, but that the roll drive is complicated, and also relatively critical roll changing is impeded by such additional cylinder structures, especially in a more or less stationary structure of these cylinders where it is necessary to loosen the connection to the rolls and/or the roller supporting members for roll changing

OBJECTS OF THE INVENTION

My invention has as its general object the provision of an improved arrangement for the hydraulic or pressure-extendible cylinders provided for balancing, as well as application of bending force to the sliding rolls and for sliding the rolls axially whereby these disadvantages are obviated.

It is another object to provide a roll stand with working and backing rolls and means for axially shifting at least the working rolls and for controlling the bending of the working rolls and balancing the upper backing roll, which is space saving so that the cylinders may be brought essentially inside of the windows in the stand uprights or posts without local weakening of the window posts, whereby its structure and orientation, neither by bulkiness nor by the required functions necessary for roll changing increase the load on the hydraulic or pressure-extendible cylinders substantially.

It is a further object of my invention to provide an improved roll stand having means for adjusting the opening between the rolls as well as balancing the rolls, wherein the roll stand has an especially compact structure.

It is also an object of my invention to provide an improved roll stand having hydraulic cylinders or pressure extendible cylinders for balancing as well as application of bending forces to the working rolls, in which excessive loads are not put on the hydraulic or pressure extendible cylinders and which has an especially compact structure, i.e. the cylinder structures do not project in an obstructive manner especially at the drive ends or service ends of the rolls and thus do not complicate roll changing.

SUMMARY OF THE INVENTION

These objects and others which will become apparent hereinafter are attained in accordance with the invention in a roll stand with axially shifting rolls comprising a plurality of axially shiftable working rolls, structural members of which are guided axially shiftably in one of a plurality of guide members, these guide members being slidable vertically along a cylinder block having at least one balancing hydraulic or pressure-extendible cylinder for balancing and bending the working rolls, and wherein the guide members are associated with at least one axially shifting hydraulic cylinder for sliding the working rolls axially.

According to my invention a plurality of balancing hydraulic cylinders acting upon the structural members of the rolls with bending and balancing forces are arranged substantially at an equal height (i.e. the same height or level) in a projecting shoulder cantilevered from but unitary with a cylinder block These balancing hydraulic cylinders are displaced, offset or spaced from each other along a direction parallel to the axis of the working rolls. They each have a balancing cylinder piston roo and these piston rods are alternately directed downward from or upward from the projecting shoulder.

Thus the hydraulic cylinders are not positioned vertically over each other for operation of the guide members, as is customary, that is, arranged over each other on the same axis, but much more essentially are provided one behind another in succession parallel to the roll axis and are staggered by the alternation from top and bottom.

By that arrangement the overall of the shoulder having the hydraulic cylinders can be reduced by almost half so that also the height of the cylinder block inside the housing window can be reduced.

These reductions of structural height on the other hand allow a stronger structure for the guide members, which when set in position allow incorporation of the axially shifting hydraulic cylinders, particularly the working cylinders, for axial shifting of the rolls, so that the usually separate more or less bulky, additional structure for roll shifting is not necessary.

The space gain is so considerable that instead of enlarging the structure for receiving the hydraulic cylinders, the structural members of the supporting rolls, particularly the upper rolls, can be constructed with conventional dimensions, and particularly can be provided with sliding supports with oil input and outflow channels.

According to a preferred embodiment of my invention the axes of the balancing hydraulic cylinders of the cylinder blocks are provided essentially on a single vertical plane. However it is also possible in another embodiment of my invention to offset the hydraulic cylinders horizontally so that their axes are displaced or staggered with respect to a common vertical central plane. In this latter case some of the hydraulic cylinders would lie slightly closer to the working rolls than others.

For transmission of both positive and also negative bending forces, that is, both the compression and tension forces, it has proved useful to form the pistons and the balancing hydraulic cylinders so that both the top and bottom surfaces of the pistons are acted on or pressed against, and whose balancing cylinder piston rods are connected with the guide pieces, for example, by seat or plate members rigidly attached to these guide pieces.

Isolated, protruding bulky axially shifting hydraulic cylinders for axial shifting of the rolls are eliminated. These axially shifting hydraulic cylinders are arranged inside the now enlarged, more practical guide pieces. It has proved to be advantageous to form the piston rods of these axially shifting hydraulic cylinders so that they are rigidly connected with the structural members of the rolls, particularly the working rolls, but so that they are detachable for easy roll changing.

It is a further feature that the piston rods of these hydraulic cylinders are provided with coupling bodies, which are attachable to lugs projecting from the structural members. The coupling member is provided with a slider overlapping and grasping a lug, but which can be drawn back along a guide to disengage it from the lug. Distortion of the supporting regions of the structural members under operation of forces transmitted by the lugs is avoided, when the structural members are provided with connecting bodies having the projecting lugs attached thereon. An unintended separation of the slider from the lug is avoided, if it is held in place by a suitably compressible spring arrangement during operation.

For separation of the slider from the lug and coupling body for easy and reliable roll changing, the slider is provided with form-fitting structural elements, which engage and hold a sliding carriage when the slider is in its base position adjacent the guide member. The sliding carriage is operated by an externally applied force, applied by, for example, a hydraulic cylinder With that it is possible to hold this sliding carriage out of engagement with the slider in the normal position of the working roll, but to adjust it by sliding to make the desired connection for roll changing when the slider reaches its base position The forces taken up by the slider are transmitted to the coupling piece, when the slider is provided with at least one locking ridge and supporting lip, which engage and hold fast in the bracketlike ends of the coupling piece According to another feature of the invention, the arrangement of the balancing hydraulic cylinders which has been shown to be advantageous comprises dividing the plurality of balancing hydraulic cylinders into groups each having two balancing hydraulic cylinders in which the spacing between the two balancing hydraulic cylinders of the group is small in comparison to the comparatively large spacing between the groups. Thus in this case there is comparatively small positional variation of the pressure points on the guide pieces positioned over each other, while on the other hand a desirably large base for the preferred two application points for the bending force is achieved.

For providing strength and work capacity in another feature of this invention for the balancing hydraulic cylinder causing the vertical balancing, the cylinder block is provided with a projection protruding between the groups of balancing hydraulic cylinders and in the cylinder block in the vicinity of this projection a balancing hydraulic cylinder for balancing the intermediate and supporting rolls is installed.

According to my invention an adjusting mechanism is provided which holds the pressure in the balancing hydraulic cylinders on the equal guide members in an appropriate proportion dependent upon a displacement pickup reproducing the axial shift of the working rolls, so that the resultant force caused by the hydraulic cylinders remains in the normal center plane between the roll ends. This regulating and adjusting, mechanism is commonly provided so as to regulate the bending force operating on the rolls, for example, the working rolls, so as to achieve the desired profile for the opening between the rolls.

It has already been proposed in the case of shiftable rolls to hold the balancing hydraulic cylinders, causing the bending forces applied to the rolls, so that the application points of the bending forces are centered about the center plane between the roll ends, in order to reduce wear and to guarantee high service life. It was also already proposed to cause the bending force on the axially shiftable rolls by at least two balancing hydraulic cylinders displaced with respect to each other or spaced from each in other in the direction of the shifting, whereby the regulation of the two hydraulic cylinders operating on a guide piece is facilitated by displacement pickups reproducing the axial shifting of the rolls. The sum of the forces caused by the balancing hydraulic cylinders yields the aimed for bending force, and the resultant of the forces caused by both balancing hydraulic cylinders is guided in the normal axis center plane between the roll ends. In shifting of the rolls the pressure in each balancing hydraulic cylinder is adjusted or readjusted by the displacement pickup detecting the shift, in such a case also by the hydraulic volume displaced the pressure of the cylinders lying forwardly in the shift direction is increased, and that of the cylinders lying to the rear in the shift direction is reduced. In such a case this variation in pressure can be conducted so that the balancing hydraulic cylinder lying to the rear in the shift direction is loaded negatively. In such a case I provide a corresponding adjusting or positioning apparatus, in which the position difference of the two hydraulic cylinders of a group is already taken account of. Thereby, regardless of the stationary arrangement and opposing displacement and aggregation of the balancing hydraulic cylinders in the cylinder blocks, the center plane between the roll ends contains the resultant of the forces caused by the hydraulic cylinders.

According to another feature of the invention four balancing hydraulic cylinders are employed in each cylinder block and two opposing cylinder blocks are attached to housing posts on opposite sides of the working rolls. Preferably the cylinder blocks are of different thickness so that the working rolls can be displaced slightly from the plane containing the supporting rolls. All in all according to my invention a compact, efficient space saving and strong structure results, which both contributes to the service life of the stand, rolls and their supports and also makes easier and speeds up the periodically required roll changing thus reducing downtime of the roll stand.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
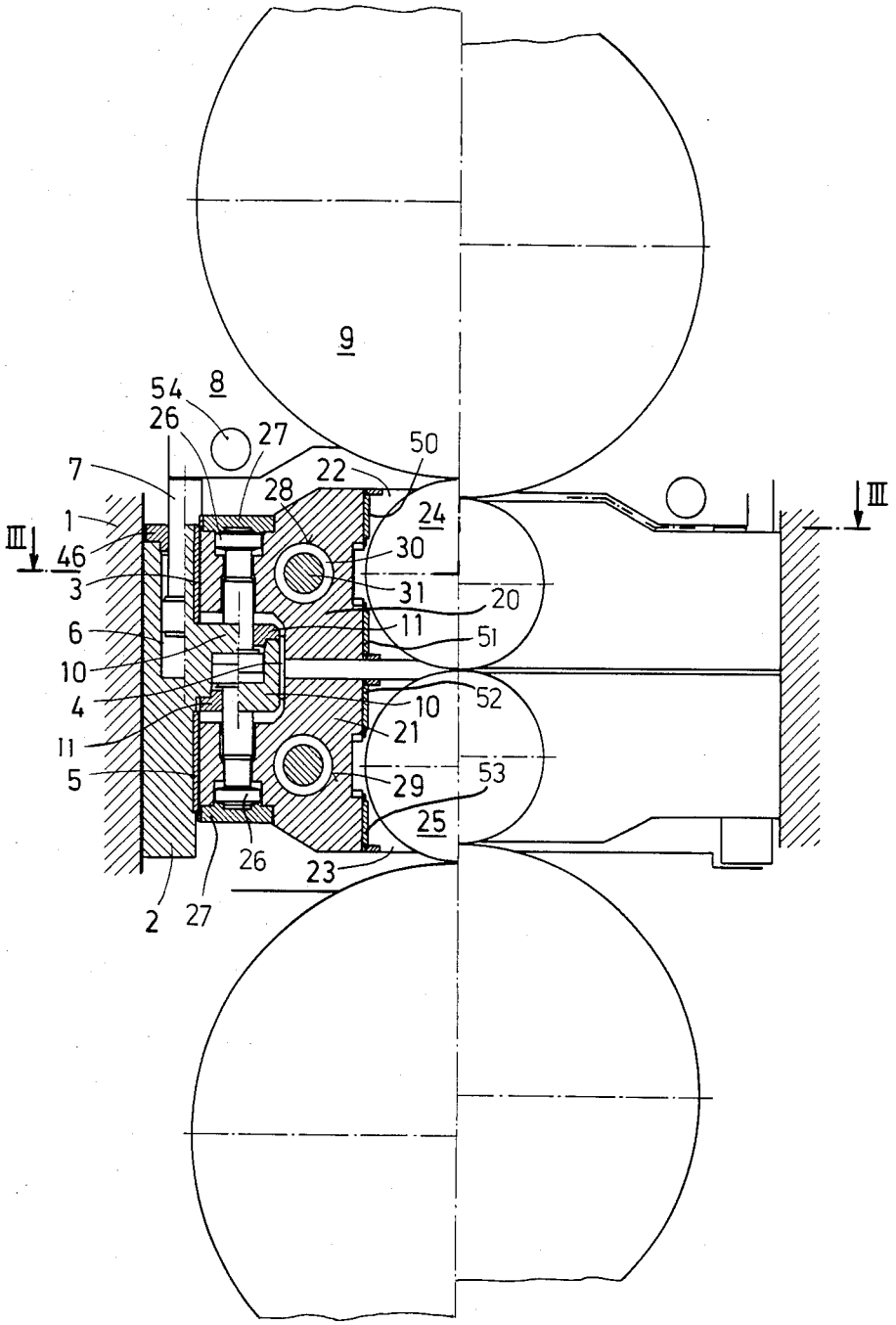
FIG. 1 is a discontinuous vertical cross section through a roll stand of four rolls according to my invention taken in different vertical planes.

In FIG. 1 a discontinuous vertical cross section in different vertical planes through a housing window of a roll stand having four rolls is shown. The housing beams 1 bordering the housing window are provided with an associated stationary cylinder block 2 having attached wear plates 3, 4 and 5. This cylinder block 2 has balancing hydraulic cylinder 6, the upwardly directed balancing cylinder piston rod 7 of which engages under a structural member 8 of supporting roll 9.

Figure 2:
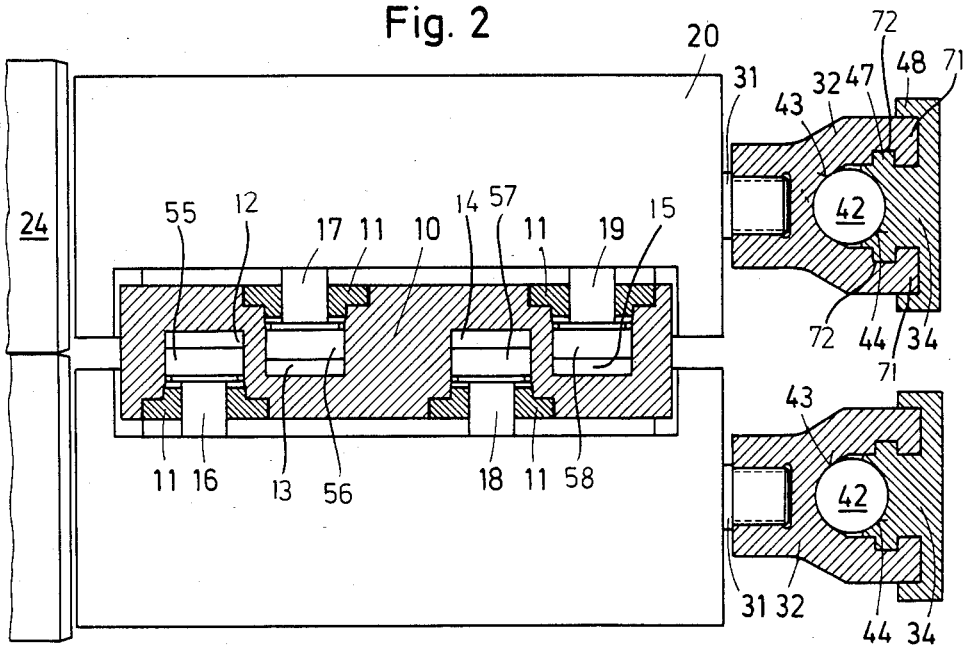
FIG. 2 is a vertical cross section through a cylinder block and guide pieces of the apparatus according to FIG. 1 taken in a plane parallel to the working roll axis.

The cylinder block 2 has a cantilevered but integral shoulder 10, in which in the axial direction of the rolls behind each other four balancing hydraulic cylinders 12, 13, 14 and 15 are provided, the corresponding balancing cylinder piston rods 16, 17, 18, and 19 of which are directed alternately downwardly and upwardly (FIG. 2).

The balancing hydraulic cylinders 12, 13, 14, and 15 are sealed and closed on the side of their balancing cylinder piston rods 16, 17, 18 and 19 by cylinder covers 11.

The balancing cylinder piston rods 16, 17, 18 and 19 pass through guide pieces 20 and 21 which are adjustable vertically along the wear plates 3, 4 and 5. The free ends of these balancing cylinder piston rods 16, 17, 18, and 19 are each provided with bottom pieces 26, which are seated and locked in position by the end pieces 27 in guide pieces 20 and 21.

Structural members 22 and 23 of the working rolls 24 and 25 are guided slidably along the corresponding adjacent sides of the guide pieces 20 and 21 in a direction parallel to the axis of the working rolls 24 and 25.

Particularly FIG. 2 shows that the balancing hydraulic cylinders 12, 13, 14, and 15 with their balancing cylinder piston rods 16, 17, 18, and 19 lie practically behind each other in a plane parallel to the axis of the working rolls 24 and 25. In FIG. 2 from left to right from the observer's point of view the balancing cylinder piston rods 16, 17, 18, and 19 are alternatingly directed downwardly and upwardly.

By this arrangement essentially the desired compact structure is produced inside of a vertical plane parallel to the roll axis.

The balancing hydraulic cylinders 12 to 15 are, therefore not associated in pairs over each other on the same cylinder axis which would enlarge undesirably the overall structural height and therefore the height of the shoulder 10, nor are the hydraulic cylinders 12 to 15 required to be next to each other, referring to FIG. 2 wherein it is clear that the arrangement is behind each other parallel to the axis of the working rolls 24 and 25; of course should the shoulder 10 be constructed with reduced height, it must extend a corresponding distance into the housing window.

The balancing hydraulic cylinders 12 to 15 are double acting cylinders; that is, they can be set up not only to balance the working rolls 24 and 25, but they can also cause both positive and negative curvature of the working rolls 24 and 25.

Here the cylinders 12 to 15 both above and below their pistons 55 to 58 are equipped with unshown inflow or inlet fittings for the fluid medium providing the required pressure, and the balancing cylinder piston rods 16 to 19 are held and anchored in position with the bottom pieces 26 with a slight play in the guide pieces 20 and 21, so that the balancing cylinder piston rods 16 to 19 are capable of transmitting both compression forces and also tension forces.

Since it proves to be the case that the common tension forces are lower than the maximum compression forces, for producing the compression forces the top surfaces of the pistons 55 to 58 are effective, while the for the drawing forces only the bottom annular surfaces of the pistons 55 to 58 surrounding the piston rods 16 to 19 are effective. Of course by "top surface" of the pistons 55 to 58 I mean the surfaces through which the piston rods 16 to 19 do not protrude and by the "bottom surface" I mean the surfaces through which the pistons rods 16 to 19 do protrude.

In the compact arrangement of this invention the points of application causing the bending forces are offset from one another in the direction of the roll axes. Reaction effects of this offset are, however, easily excluded The working rolls are shiftable in the direction of their long axis, so that, for example with the socalled bottle rolls, the curvatures of the surfaces of the working rolls define the desired shape of the opening when the rolls are shifted axially relative to one another. That means that the working rolls to the requisite extent must be permitted to shift axially relative to one another.

On the other hand it is necessary in order to attain a long service life of the roll support of the roll ends to bring the bending force into the central plane between the supports.

This is attained, of course, by actuation of the hydraulic cylinders 12, 13, 14, and 15 causing the bending of the working rolls 24 and 25, which requires a mechanical driving force which is comparatively large.

The support of the structural members 22 and 23 of the working rolls 24 and 25 is effected, consequently by two hydraulic cylinders, which are acted upon by an unshown central or adjusting mechanism dependent on a displacement pickup or sensor which detects axial shifts of the working rolls, so that the sum of the forces acting on the rolls correspond to the desired bending forces and that further the effective direction (line of application) of the net or resultant force in the axial shift direction of the working rolls is guided to the normal center plane of the working rolls. In this case it is necessary to construct the control and/or adjusting mechanism of each group of hydraulic cylinders each of which operate either downwardly or upwardly so that the different requirements of each group are taken into account and the effects are equalized.

Also according to FIG. 2 the hydraulic cylinders 12 and 13 are positioned comparatively closely to each other, in order to exclude mutual counteracting influences and to guarantee the stability of the cylinder block, with a minimum wall thickness between both cylinders just sufficient to provide the necessary strength but on the other hand, to have only a small distance between the cylinder axes. The group of hydraulic cylinders 14 and 15 is offset a significant distance from the first group of cylinders 12 and 13, so that an effective equalization of the roll displacements can be conducted. Within each group of cylinders 12 and 13 or 14 and 15 however a comparatively smaller reduced mutual distance is striven for.

Figure 3:
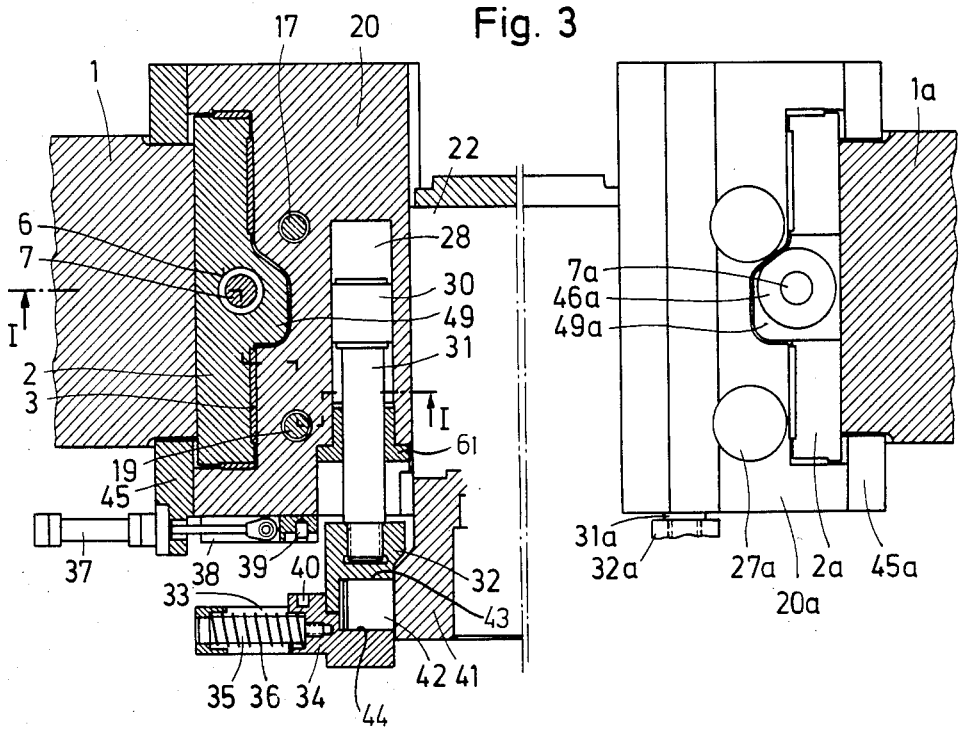
FIG. 3 is a horizontal cross section through parts of a housing window of the apparatus according to FIG. 1.

By the described serial arrangement of the hydraulic cylinders 12, 13, 14, and 15 the reduced height of the shoulder 10 allows the guide pieces 20 and 21 to be constructed with a comparatively high midportion, which makes possible the housing of the axially shifting hydraulic cylinders 28 and/or 29 therein as shown by FIGS. 1 and 3. The force of these cylinders effects the axial shifting of the working rolls 24 and 25. As is particularly shown in FIG. 3, the axially shifting hydraulic cylinder 28 extends through the guide piece 20 and is sealed at its free end by a cylinder cover 61.

The axially shifting cylinder piston 30 is equipped with shifting cylinder piston rod 31, which slidably penetrates the cylinder cover 61 and, for example, in the shown structure is connected rigidly to a coupling body 32, on which a slider 34 runs.

The slider 34 is connected with and engaged on a guide pin 35, which is held in and penetrates a hole in the guide 33 and a compressible spring 36 surrounding guide pin 35 centers the coupling body 32 in position against the guide 33. On the guide piece 20 and/or the guide strip 45 attached to guide piece 20 a slider hydraulic cylinder 37 is provided, which is engaged to a sliding carriage 38 movable horizontally along the side of the guide piece 20. The sliding carriage 38 is equipped on its side with a locking pin 39.

For roll changing by means of the axially shifting cylinder piston 30 of the cylinder 28 the coupling body 32 can be drawn in synchronization with structural member 22 against the guide piece 20 which supports the working roll 24. Then the coupling body 32 is said to be in the base position. Then the locking pin 39 engages in a hole 40 provided in slider 34, so that by means of the slider hydraulic cylinder 37 and the sliding carriage 38 engaged over the locking pin 39, the slider 34 can be drawn to the left in FIG. 3 against the compression force of the compressible spring 36. In order that the lugs 42 can be easily released to the exterior the connecting body 41 is provided with lugs 42 on the front side instead of on a supporting roof of structural member 22. The connecting body 41 before disengagement is held on one side by the recess 43 of the coupling body 32 and on the opposite side by the recess 44 of the slider 34. Thus now a roll change can be undertaken easily and quickly.

The horizontal arrangement of the axially shifting hydraulic cylinders 28 and/or 29 in the guide pieces 20 and/or 21 proves extraordinarily advantageous, since the required shifting motion of the working rolls 24 and 25 can be included here without requiring a particular mounting or attachment means. Now the coupling body 32 and the connecting body 41 appear instead. This connecting body 41 however is constructed so that it can take the position of the common support cover occluding the roll ends and to be able on the other hand to take up the transmitted shifting forces and to be guided centrally so that the stressing of the individual structural members is avoided. Also the small distance of the axially shifting hydraulic cylinder 28 or 29 from the structural members 22 and 23 acts just as favorably as placing the axially shifting hydraulic cylinder 28 or 29 in the horizontal plane of the roller axis, so that horizontal moments are fundamentally precluded, while vertical moments are avoided by the symmetrical engagement of each side.

The coupling of the structural members 22 and 23 with the axially shifting mechanism is carried out on the one hand so as to be able to handle a heavy load, while on the other hand so as to be easily detachable for roll changing. The coupling is herein laid out so that on the one hand the driving force causing the horizontal shifting is transmitted, but on the other hand the essentially higher points of application of force are acceptable without more. On this basis the guiding of the slider 34 is facilitated not only by the guide 33 arranged sidewise to the coupling body 32, but the slider 34 itself engages slidably in a raillike, bracketlike end 71 of the coupling body 32, as one learns from FIG. 2. The slider 34, which with its recess 44 supports the lug 42, is equipped with locking ridges 47 engaging in grooves 72 in the coupling body 32, while on the other hand the free bracketlike end 71 of the coupling body 32 is held to prevent loosening by the supporting lip 48 of the slider 34.

The upper backing roll 9 together with its structural members 8 the balancing hydraulic cylinder 6 is constructed with a sufficiently large diameter for balancing. In order to guarantee sufficiently the strength of the interior of the cylinder block 10 or 10*a*, as shown in FIG. 3, the middle region above the shoulder 10 is equipped with an additional projection 49, and also accordingly the wear plates 3 are extended to this projection 49. FIG. 1 also shows the wear plates 50 and 51 which effect a lateral guiding as well as the wear plates 52 and 53, which in combination with guide strip 45 provide a vertical guiding and holding of the guide pieces 20 and 21, when in roll changing the structural members 22 or 23 are shifted out.

A view of the opposite window-structure components of the roll stand is shown in the right side of FIG. 3. A second cylinder block 2*a* is attached to the second window post 1*a*, the second cylinder block 2*a* having a reduced thickness in contrast to that of the first cylinder block 2, so that the working rolls 24 and 25 are offset by a slight fixed amount with respect to the plane containing the supporting roll axes.

This slight displacement of the working rolls 24 and 25 in the roll axis direction achieved by the unsymmetrical situation based on the differences of the cylinder blocks 2 and 2a reduces the stress or load forces on the working rolls 24 and 25 and likewise stabilizes by an additional supporting component their running on the supporting rolls and reduces their horizontal bending.

FIG. 3 shows, partially broken away, those components, which have already been described with respect to other figures. So the upper side of the guide piece 20a with the attached end piece 27a is likewise discernible as is the piston rod 7a and the cylinder cover 46a sealing the hydraulic cylinder which facilitates balancing the supporting roll 9. Also in FIG. 3 the projection 49a is discernible, reaching the side of the cylinder cover 46a. In the view shown in FIG. 2 only a short portion of the piston rod 31 of the axially shifting cylinder 28 causing the horizontal shifting of the working rolls 24 and 25 is discernible which is connected with the coupling body 32 shown broken away from it. In FIG. 3 also the guide strips 45a are connected with the guide piece 20a.

The cylinder blocks 2 and 2a and the guide pieces 20 and 21 have proven extraordinarily advantageous, since the required structural components are brought together in a relatively simple and extremely reliable compact structure.

Thus in this example ih the first cylinder block the five balancing cylinders are assembled in the smallest possible space, wherein the cylinder 6 is positioned in projection 49 ih the space between both groups of balancing hydraulic cylinders 12 and 13 as well as 14 and 15. By this arrangement of the balancing hydraulic cylinders 12, 13, 14, and 15 provided for balancing and bending positioned in equal height a reduced height of the outer ends of the guide pieces 20 and 21 is achieved. So that, for example, no difficulties exist, the guide roll support arrange ment requires oil hole 54 in the associated structural member 8. Particularly the arrangement cantilevered to the front for the shifting of the working rolls is economical. The required axially shifting cylinders 28 and 29 are arranged in the inside of the guide pieces 20 and 21 and their entire length is not completely used in this embodiment; on the other hand they are constructed with a sufficient diameter in order to be able to develop the required shifting force with tolerable pressure. Also this is possible only by the reduction of the height of the shoulder 10, which is reliazable by arrangement of the space containing the hydraulic cylinders at substantially equal heights.

Figure 4:
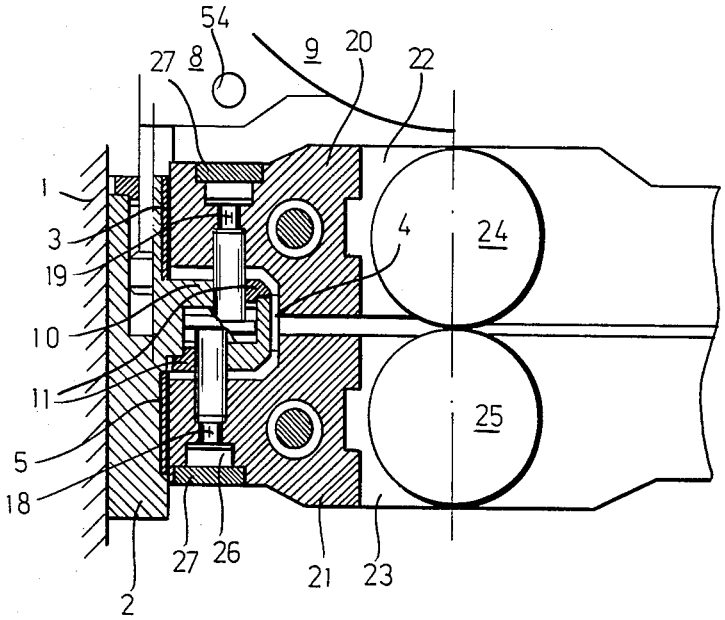
FIG. 4 is a discontinuous vertical cross section through an alternative embodiment of the roll stand of my invention similar to FIG. 1.

Alternatively another embodiment of the roll stand of my invention is indicated in FIG. 4. FIG. 4 is similar to FIG. 1, but shows an embodiment in which the balancing hydraulic cylinders 13 and 15 are displaced from a central vertical plane toward the working rolls 24 and 25 and the balancing hydraulic cylinders 12 and 14 are displaced from the central vertical plane away from the working rolls 24 and 25. Otherwise the two embodiments presented here are substantially the same.

I claim:

1. In a roll stand comprising a plurality of axially shiftable working rolls, each of said working rolls having at least one structural member attached thereto; a plurality of guide pieces, each of said guide pieces having one of said working rolls connected axially slidably thereto by at least one of said structural members, said guide pieces being slidable substantially vertically along at least one cylinder block by at least one balancing hydraulic cylinder mounted in one of said cylinder blocks for balancing and working roll bending, and at least one of said guide pieces is associated with at least one axially shifting hydraulic cylinder which causes said axial shifting of one of said working rolls, the improvement wherein a plurality of said balancing hydraulic cylinders acting upon said structural members having said working rolls connected thereto with balancing and bending forces are positioned in at least one projecting shoulder of said cylinder blocks, said balancing hydraulic cylinders are displaced from each other in a direction parallel to the axes said working rolls, each of said balancing hydraulic cylinders having a balancing cylinder piston rod, said balancing cylinder piston rods of said balancing cylinders taken individually along said direction parallel to said axis of said working rolls projecting alternately downward and upward from said shoulder to engage and act on said guide pieces of said working rolls, said axially shifting cylinder being located in said one of said guide pieces, a shifting cylinder piston rod of said axially shifting hydraulic cylinder being respectively provided with a coupling body attached to the free end of said shifting cylinder piston rod, said coupling body being connected to and providing a means of attachment to a lug jutting out from one of said structural members.

2. The improvement according to claim wherein said balancing hydraulic cylinders are positioned at the same height in said shoulder of said cylinder blocks and the axes of said balancing hydraulic cylinders associated with one of said cylinder blocks lie in a common substantially vertical plane.

3. The improvement according to claim wherein both the top surface and the bottom surface of the pistons of said balancing hydraulic cylinders are acted upon and said balancing cylinder piston rods are attached to said guide pieces.

4. The improvement according to claim 1 wherein said axially shifting hydraulic cylinders causing said axial shifting of said working rolls are positioned in said guide pieces.

5. The improvement according to claim 4 wherein the shifting cylinder piston rods of said axially shifting hydraulic cylinders are connected to said structural members of said working rolls.

6. The improvement according to claim 1 wherein each of said couplng bodies is provided with a slider engaging and overlapping said lugs, said slider being retractable along a guide.

7. The improvement according to claim 6 wherein said structural members of said working rolls are provided with a connecting body having said lug jutting out therefrom.

8. The improvement according to claim 7 wherein said slider is held braced in position for operation by a compressible spring.

9. The improvement according to claim 8 wherein said slider is provided with form-fitting structural elements for engagement with and coupling to a sliding carriage, which is operated by an applied force, when said coupling member is in a base post on in which said coupling member is adjacent said guide piece.

10. The improvement according to claim 9 wherein said slider has two locking ridges and two supporting lips, which engage slidably two bracketlike ends of said coupling body to provide a strong, but detachable, coupling between said slider and said coupling body.

11. The improvement according to claim 9 wherein said plurality of balancing hydraulic cylinders is divided into a plurality of groups of two adjacent balancing hydraulic cylinders, wherein the spacings between said two adjacent balancing hydraulic cylinders of each of said groups are smaller than the spacings between each of said balancing hydraulic cylinders next to each other in adjacent ones of said groups.

12. The improvement according to claim 11 wherein said cylinder blocks have a lateral projection positioned between two of said adjacent groups of said balancing hydraulic cylinders, and that in the vicinity of said projection said cylinder blocks have an additional balancing hydraulic cylinder for balancing of at least one intermediate or supporting roll of said roll stand.

13. The improvement according to claim 12 wherein said plurality of balancing hydraulic cylinders comprises four balancing hydraulic cylinders.

14. The improvement according to claim 13 wherein two of said cylinder blocks are provided and said cylinder blocks have different thicknesses.

15. The improvement according to claim 1 wherein said working rolls are arranged displaced slightly in the rolling direction from the vertical plane containing the axes of at least one supporting roll of said roll stand.

16. The improvement according to claim 1 wherein each of said balancing hydraulic cylinders associated with one of said cylinder blocks is positioned displaced from a central vertical plane.

17. In a roll stand of a strip rolling mill of the type in which a pair of working rolls is disposed between a pair of backing rolls, said stand comprising a frame having uprights provided with respective windows, said working rolls each being journaled at each of said uprights on a respective member shiftable relative to said uprights in a direction of the axis of the respective working roll and vertically along the respective upright, the improvement which comprises:

a respective cylinder block disposed in each of said windows and vertically guided therein, each of said cylinder blocks being formed with a respective ledge projecting inwardly of the stand and extending parallel to axes of said working rolls;

two pairs of hydraulic bending and balancing cylinders respectively formed in each of said ledges, said pairs of cylinders in each ledge being spaced apart by a distance parallel to said axes greater than the spacing of the cylinders of each pair, said cylinders receiving respective pistons disposed so that a piston of one of the cylinders of each pair acts upon one of said members at the respective upright and the piston of the other cylinder of each pair acts upon the other of said members at the respective upright, and the piston of the cylinders of each ledge alternate therealong in a direction parallel to said axes with respect to the members upon which said pistons act; and at least one axially effective hydraulic cylinder formed in each of said members and acting upon a journal of the respective working roll to displace said rolls axially.

18. The improvement defined in claim 17 wherein each of said hydraulic bending and balancing cylinders is a double-acting cylinder.

19. The improvement defined in claim 18 wherein said hydraulic bending and balancing cylinders are positioned at the same level in the respective ledge and the axes of said bending and balancing cylinders of each ledge lie in a common substantially vertical plane.

20. The improvement defined in claim 17 wherein said working rolls have their axes offset slightly in a rolling direction from a vertical plane containing the axes of said backing rolls.

* * * * *